United States Patent [19]

Mishek

[11] 4,295,615

[45] Oct. 20, 1981

[54] SHELL LINER ASSEMBLY FOR ORE COMMINUTING MACHINE

[75] Inventor: James E. Mishek, Arden Hills, Minn.

[73] Assignee: Minneapolis Electric Steel Castings Company, Minneapolis, Minn.

[21] Appl. No.: 79,385

[22] Filed: Sep. 27, 1979

[51] Int. Cl.[3] ..... B02C 17/22

[52] U.S. Cl. ..... 241/182; 241/299

[58] Field of Search ..... 241/182, 183, 284, 299

[56] References Cited

U.S. PATENT DOCUMENTS

| | | | |
|---|---|---|---|
| 887,575 | 5/1908 | Barry | 241/182 |
| 1,055,395 | 3/1913 | Globe | 241/183 |
| 1,128,901 | 2/1915 | Posselt . | |
| 1,295,289 | 2/1919 | Fasting . | |
| 1,315,025 | 9/1919 | Lawler | 241/183 |
| 1,470,420 | 10/1923 | Askin et al. . | |
| 1,534,000 | 4/1925 | Baker . | |
| 1,807,034 | 5/1931 | Hardinge . | |
| 1,872,036 | 8/1932 | Hardinge . | |
| 2,216,784 | 10/1940 | Payne | 241/182 X |
| 3,065,920 | 11/1962 | Johnson et al. | 241/182 X |
| 3,404,846 | 10/1968 | MacPherson et al. . | |
| 3,462,090 | 8/1969 | Landes et al. | 241/299 |
| 3,582,007 | 6/1971 | Heighberger . | |
| 3,630,459 | 12/1971 | Slegten . | |
| 3,680,799 | 8/1972 | Hallerback . | |
| 3,701,487 | 10/1972 | Quesnel et al. . | |
| 3,804,346 | 4/1974 | Norman . | |
| 3,949,943 | 4/1976 | Schuler et al. . | |
| 4,018,393 | 4/1977 | Larsen . | |
| 4,046,326 | 9/1977 | Larsen . | |
| 4,165,041 | 8/1979 | Larsen . | |

FOREIGN PATENT DOCUMENTS

| | | |
|---|---|---|
| 1131489 | 6/1962 | Fed. Rep. of Germany . |
| 2305311 | 8/1974 | Fed. Rep. of Germany . |
| 47-4388 | 3/1967 | Japan . |
| 8619 | 3/1914 | United Kingdom . |

*Primary Examiner*—Howard N. Goldberg

*Attorney, Agent, or Firm*—Merchant, Gould, Smith, Edell, Welter & Schmidt

[57] ABSTRACT

The disclosure is directed to an improved liner assembly for the cylindrical drum or shell of an ore grinding machine. The liner assembly comprises a plurality of holder segments each of which is formed with a longitudinal channel that is closed at the bottom and opens upwardly or toward the shell center. Each channel has longitudinal sides that converge toward the exposed or upper surface of the wear segment. Wear inserts of abrasion resistant material are inserted lengthwise into the channels, each having a cross section that conforms to the channel to be retained within it. The holder segments are mounted to the shell in axial rows with the inserts in end relation to present a continuous ridged wear surface over the entire axial length of the liner assembly.

24 Claims, 3 Drawing Figures

SHELL LINER ASSEMBLY FOR ORE COMMINUTING MACHINE

The invention relates generally to apparatus for comminuting ore, and is specifically directed to an improved liner assembly for an ore grinding mill used in commercial mining operations.

Grinding mills of this type may employ rods or balls to assist in the comminuting process as the mill is rotated, or the ore may be self-grinding in large autogenous mills. An example of the latter type mill consists of a large cylindrical drum mounted on bearings for rotation about a substantially horizontal axis and driven by a powerful motor through conventional reduction gearing. The axial ends of the drum are open, and the material to be comminuted is continuously fed into the mill at one end with the comminuted product continuously emerging from the other end.

From the economic standpoint, it is important to keep any type of ore grinding mill in operation as continuously as possible, keeping the downtime for maintenance or repair to a minimum. However, many ores (e.g., taconite) are extremely hard and highly abrasive, and in order to maintain continuous operation of the grinding mill, it is necessary to provide a liner for the drum which is highly abrasion resistant, and also tough enough to withstand the continuous impact of the ore fragments.

Due to size and weight considerations, liner assemblies for one grinding mills of this type are typically segmented; i.e., they comprise a plurality of separate components that are individually secured to the drum or shell of the mill. U.S. Pat. No. 4,018,393, which issued to Darrell R. Larsen on Apr. 19, 1977, and which is commonly assigned with this patent application, is typical of this type of liner assembly, disclosing a plurality of individual liner segments which are uniquely secured to the inside of the cylindrical shell in circumferential and axial rows.

In U.S. Pat. No. 4,046,326, which also issued to Darrell R. Larsen on Sept. 6, 1977, it was recognized that the structural configuration of liner segments is necessarily complex, and does not lend itself to fabrication from materials which are highly abrasion resistant. Examples of ideal materials for this use are martensitic white iron or martensitic steel, both of which are extremely abrasion resistant. However, since materials such as these undergo a significant volume change as they pass from the austenitic stage to martensitic form, it is extremely difficult to form from such materials an article of significant size or complex configuration since the transformation from martensite, as the result of rapid cooling, may crack the article and render it useless in an ore crushing operation. Thus, prior to the invention disclosed and claimed in U.S. Pat. No. 4,046,326, segmented liners were usually made from a "tough" material which offered relatively good resistance to impact, although its resistance to abrasion was somewhat lower. U.S. Pat. No. 4,046,326 was, therefore, directed to a liner assembly in which the primary structure of each liner segment is made from a "tough" material, coupled with the use of one or more inserts formed from highly abrasion-resistant material in a manner such that the insert or inserts represent primary exposure to the ore fragments but are always retained, even if they break due to brittleness. With such an assembly, the inserts can be made in fairly simple configurations to overcome the fabrication problem mentioned above, and thus enabling the use and benefits of abrasion-resistant materials.

The use of hardened inserts substantially increases the life of the liner assembly, and as a result reduces the mill downtime encountered with previous liner assemblies that wore down more quickly and required changing more frequently. However, the changing of liner assemblies has remained an arduous task and requires a substantial number of man hours.

A U.S. patent application filed in the name of Darrell R. Larsen on Aug. 11, 1978 under Ser. No. 932,711, now U.S. Pat. No. 4,235,386 and entitled "Shell Liner Assembly for Ore Grinding Mills", and also owned by the assignee of this invention, is directed to a liner assembly which simplifies liner renewal by requiring replacement of only the hardened wear insert. This is accomplished by securing each of a plurality of holder segments directly to the shell, and providing a plurality of wear segments which are secured directly to the holder segment.

This invention constitutes an improvement of the liner assembly of the aforementioned patent application. The improved liner assembly comprises a plurality of longitudinal holder segments, each of which defines a mounting surface constructed for mounting engagement with the cylindrical shell. The holder segments are connected directly to the cylindrical shell in circumferential and axial rows, and each further defines a grinding surface which, in the mounted position, faces radially inwardly.

Each longitudinal holder segment further defines a longitudinal channel extending from one end of the holder segment to the other end and opening inwardly or toward the drum center. The longitudinal channel is closed at the bottom, and is defined by longitudinal sides or faces that converge toward the grinding surface or the center of the drum.

One or more longitudinal wear inserts are provided for each channel. The wear inserts have a transverse cross section which conforms to the channel, and each thus defines external longitudinal sides or faces that converge from the bottom to the top. As constructed, each of the inserts slides into the longitudinal channel from either end and is retained in the channel because of the tapered configuration.

In the preferred embodiment, the holder segments are cast from a "tough" material which offers good resistance to impact but with lesser resistance to abrasion. The configuration of the holder segment casting is reasonably complex, and to insure uniformity over the length of the channel sides a plurality of bridge elements are integrally cast over the top of the channel. These bridge elements are relatively thin, and although they maintain the proper spacing relation between the channel sides during the casting process, they wear away relatively quickly when the assembly has been placed in operation.

The bridge elements thus provide two important functions. First, they maintain uniformity in channel side spacing as mentioned above. Secondly, after they wear away, the top face of the wear inserts presents a continuous wear surface over the entire axial length of the liner assembly. With the holder segments arranged in circumferential and axial rows, the result is a plurality of axially extending comminuting ridges each of which is axially continuous over its length. Continuity of the wear surface or ridge is important because it prevents increased wear in specific areas, which occurs with non-continuous wear surfaces. In other words, if the wear surfaces are formed from abrasion-resistant material but are not continuous over the axial length of the liner assembly, the intermediate areas of lesser resistant material between the inserts wear more quickly, thus requiring a premature replacement of the liner assembly. Further, these more rapidly wearing areas may create circumferential races or grooves extending around the liner face, which inhibit proper comminution.

Because of this particular construction, the wear inserts themselves are of simple configuration. As such, they are easily cast and treated for high resistance to abrasion without the problems attendant with complex casting from such materials.

The advantages and features of the inventive linear assembly will be fully appreciated from the drawings and description below.

DESCRIPTION OF THE PREFERRED EMBODIMENT

Figure 1:
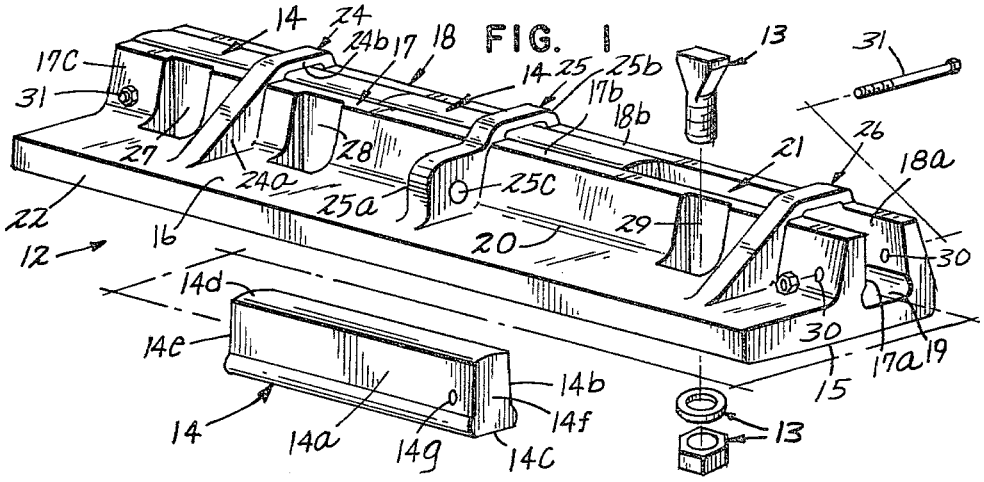
FIG. 1 is an exploded perspective view of a holder segment and a plurality of wear segments for a liner assembly in accordance with the invention.
Figure 2:
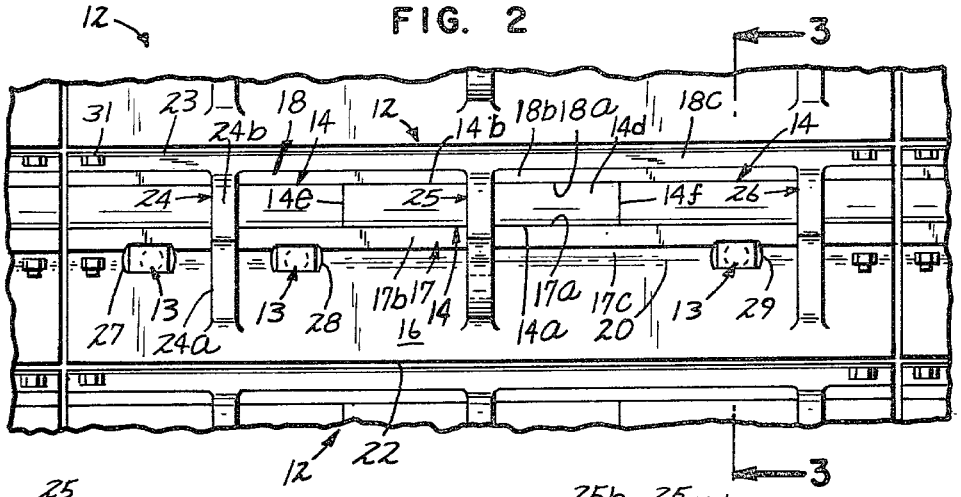
FIG. 2 is a fragmentary view in top plan of several of the holder segments and wear inserts forming the liner assembly.
Figure 3:
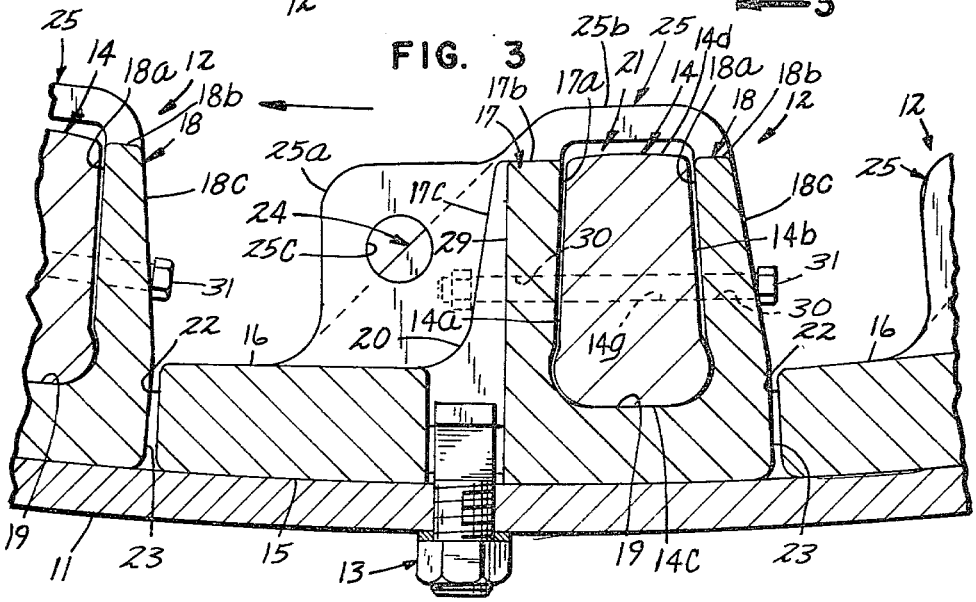
FIG. 3 is an enlarged fragmentary transverse sectional view of the holder segments and wear inserts mounted to the cylindrical shell of an ore grinding machine, the section taken along the line 3—3 of FIG. 2.

FIGS. 1–3 disclose a segmented liner assembly according to the invention and adapted for use with a cylindrical drum or shell 11 of an ore grinding machine. The ore grinding machine may be of the type disclosed in U.S. Pat. No. 4,046,326, in which the hollow cylindrical drum or shell 11 is constructed and arranged for rotation about a substantially horizontal axis. The drum or shell 11 is substantially closed by axial end walls with the exception of central axial openings through which the ore is respectively supplied and discharged.

With reference to the drawings, the liner assembly comprises a plurality of holder segments 12 fastened directly to the shell 11 by nut and bolt assemblies 13, described more fully below, and a plurality of wear segments 14. Both the holder segments 12 and wear segments 14 are generally elongated, but as shown in FIGS. 1 and 2, the preferred embodiment includes three wear segments 14 for each of the holder segments 12.

As shown in FIGS. 2 and 3, the segments 12, 14 are arranged in a plurality of rows which are substantially parallel with the axis of rotation of the shell 11, the rows being disposed in close proximity to substantially cover the inner cylindrical surface of shell 11. The shell 11 is rotated in the direction indicated in FIG. 3, and the irregular contour of the segmented liner assembly causes the ore fragments to be carried upward with rotation of the drum, where they are dropped and tumbled downward in a comminuting manner.

With specfic reference to FIG. 3, each of the holder segments 12 defines a slightly arcuate mounting surface 15 which conforms to the inner cylindrical surface of the shell 11. The exposed comminuting surface of each holder segment 12 comprises a lower flat surface 16 that extends over the length of the segment 12 and occupies approximately one-half of its transverse width.

Also extending over the entire length of each segment 12 are first and second longitudinal walls 17, 18 that project upwardly, or in other words, radially inward. The walls 17, 18 define inner longitudinal faces **17*a*, 18*a*, respectively, which are disposed in opposed relation, and which converge away from the mounting surface 15; i.e., toward the center of the drum 11**.

The faces **17*a*, 18*a* diverge toward the mounting surface 15 but terminate short thereof in a bottom wall 19** that defines a smooth, slightly enlarged bottom socket.

As constructed, the side walls 17, 18 and bottom 19 together define a longitudinal channel 21 extending from one end of the holder segment to the other, and opening upwardly or toward the drum center.

The longitudinal side walls 17, 18 are of substantially the same height, and terminate in top surfaces **17*b*, 18*b*** which are flat and substantially coplanar.

Longitudinal wall 17 has an external face **17*c* that blends smoothly into the lower flat surface 16 through a fillet 20. Inner and outer faces 17*a*, 17*c* converge toward the center of the drum so that the longitudinal wall 17 has a tapered cross section, as best shown in FIG. 3**.

Longitudinal wall 18 has an external face **18*c* that tapers in substantially the same manner and is symmetrical with the external face 17*c*. Longitudinal wall 18 has a tapered cross section similar to that of wall 17, but, as shown in FIG. 3, its cross section is somewhat thinner than that of the wall 17**.

Each of the holder segments 12 has a leading or forward edge 22 that is transverse to the surfaces 15, 16, and is preferably substantially perpendicular thereto. Each holder segment 12 further defines a rear or trailing edge 23 which is also substantially perpendicular to the mounting surface 15. External face **18*c* angles upward slightly from trailing edge 23, as best shown in FIG. 3**.

Each of the holder segments 12 is also provided with three transverse bridge members 24–26. As shown in FIG. 2, bridge member 25 is centered relative to the length of segment holder 12, whereas bridge members 24 and 26 are unevenly spaced on each side thereof.

Bridge members 24 and 26 are identical, and a description of bridge member 24 is exemplary for both. Bridge member 24 comprises a generally triangular reinforcement **24*a* that is integrally formed with the lower flat surface 16 and the external face 17*c*. Bridge member 24 further comprises a spanning member 24*b* that is integrally formed with the top edges 17*b*, 18*b* and spans the longitudinal channel between walls 17, 18**.

Bridge member 25 is different only in that its reinforcing member **25*a* is somewhat larger and includes a transverse bore 25*c* which may be used for lifting the holder segment 12** by a crane or the like during mounting of the liner assembly.

As constructed, the bridge members 24–26 provide reinforcement of the wall member 17 through the reinforcing members **24*a*–26*a*, and the spanning members 24*b*–26*b* serve to maintain proper alignment and spacing of the inner faces 17*a*, 18*a* during the casting process. This insures that the wear segments 14** will fit properly into the longitudinal channel.

Each of the holder segments 12 includes three mounting openings 27–29 which are identical in configuration but nonuniformly spaced over the length of the segment holder 12. Mounting openings 27, 28 are disposed on opposite sides of the bridge member 24, whereas mounting opening 29 is disposed longitudinally inward of the bridge member 26.

A description of mounting opening 29 which is shown in detail in FIG. 3, will be exemplary of the other mounting openings. The opening 29 comprises a bore which is generally rectangular when viewed in transverse cross section. The opening 29 extends from the top edge 17*b* of longitudinal wall 17, and its rectangular width encompasses part of the lower flat surface 16. As such, the top opening of the mounting bore 29 is irregular in shape, as best shown in FIG. 1.

The bolt of the nut and bolt assembly 13 has a head with parallel side faces, and is sized to cooperate with the mounting bore 29 in such a manner that the bolt cannot be rotated upon insertion. The bolt head is also wedge-shaped, so that upon insertion through the mounting opening 29 and a registering mounting opening in the drum 11, tightening of the nut will tightly draw the holder segment 12 against the drum 11 along the mounting surface 15. This best shown in FIG. 3.

In the preferred embodiment, three wear segments 14 are provided for each holder segment 12, taking up the entire length of the holder segment channel. Each wear segment 14 comprises a solid, elongated member having side surfaces 14*a*, 14*b* that taper in a manner similar to the inner faces 17*a*, 17*b*.

Wear segment 14 has a bottom surface 14*c* that corresponds in configuration to the bottom 19 of the longitudinal channel of holder segment 12. This bottom region has slightly enlarged, rounded sides, giving it a slightly bulbous shape that conforms to the bottom socket of the longitudinal channel.

Each wear segment 14 has a very slightly rounded top surface 14*d*, and its overall height is such that the surface 14*d* projects very slightly above the top edges 17*b*, 18*b*. This dimensional relationship is not critical, but it is desirable that the wear segment 14 be at least as high as the longitudinal walls 17, 18 to properly perform its function.

Each wear segment 14 has flat, parallel end walls 14*e*, 14*f* that are substantially perpendicular to its longitudinal axis. This enables the wear segments 14 to abut each other closely (FIG. 2), and thus establish a continuous wear surface over the entire length of each holder segment 12.

In the preferred embodiment, one end of each wear segment 14 is formed with a transverse bore 14*g* that is sized and positioned for registration with one of two transverse mounting bores 30 which are formed through the wall members 17, 18 at each end of the holder segment 12. A nut and bolt assembly 31 secures the end wear segments 14 in place as shown, which simultaneously retains the center wear segment 14.

Alternatively, or in addition to the locking bolt assemblies 31, each of the wear segments 14 could be "buttered" with epoxy before entry into the longitudinal channel, which would also secure the wear segments 14 in the channel.

In the preferred embodiment, the holder segments 12 are formed from tough, impact-resistant material which is difficult to break and therefore capable of retaining the wear segments 14 throughout their wear life. The wear segments 14 are preferably formed from material which is highly resistant to abrasion. Several materials are capable of use for both the holder segments 12 and wear segments 14. Preferably, however, martensitic steel is used for both, which can be heat treated to be either tough and impact resistant, or highly resistant to abrasion. The procedures for obtaining these performance characteristics are well known in the metallurgical art.

Another suitable example of an abrasion-resistant material for the wear segments 14 is martensitic white iron. Manganese steel may also be used as a tough material from which the holder segments 12 may be formed.

As constructed, the holder segments 12 are initially installed with the use of nut and bolt assemblies 13. This task is carried out from both inside and outside the shell 11, but it is less frequently required. Next, the wear segments 14 are installed only from within the shell 11 with the nut and bolt assemblies 31 and/or with the use of epoxy as described above.

As assembled, and with the direction of rotation indicated in FIG. 4, the top end of longitudinal wall 17 is initially exposed to substantial wear by the ore fragments as they are carried upwardly and then tumble down due to gravity. However, since the entire holder segment 12 is formed from material which wears down more quickly than that of the wear segment 14, the upper end of the longitudinal wall 17 tends to wear away due to this exposure. As this occurs, the wear segment 14 then bears the primary burden of ore fragment contact during the comminution process. Since it is formed from highly abrasion-resistant material, it wears extremely well and requires replacement far less frequently than segments formed in their entirety from materials which do not have high abrasion resistance.

With specific reference to FIG. 3, it will be noted that the holder segments 12 are so constructed that, in assembled relation, the upstanding longitudinal walls 17, 18 and the wear segments 14 are spaced from the walls 17, 18 and wear segments 14 of adjacent holder segments 12 in each circumferential direction. This means that the cylindrical drum 11 may in fact be rotated in a direction opposite that shown in FIG. 3 with the same comminuting result. With the direction so reversed, the upstanding longitudinal wall 18 is now exposed to the ore fragments as they are carried upwardly and tumbled downward. As such, reversal of the rotation of drum 11 permits a doubled wear life before replacement of the wear segments 14 or an entire liner assembly is necessary.

In either direction of rotation, it will also become apparent that the spanning members 24*b*–26*b* are initially exposed to substantial wear by the ore fragments. Accordingly, these elements wear away rather quickly, which they are intended to do since their primary function is one of maintaining the aligned relationship of walls 17, 18 during the casting process.

However, in addition, at the time the spanning members 24*b*–26*b* wear away, they also present a continuous, axially extending wear ridge, as defined by the end-to-end wear segments 14, which runs the entire axial length of the drum 11. Since the liner assembly comprises holder segments 12 and wear segments 14 disposed in axial and also circumferential rows, it will be appreciated that the comminuting surface comprises a plurality of axially extending ridges which are circumferentially spaced around the entire inner cylindrical surface of the drum 11.

The axial continuity of these comminuting ridges is important, since it obviates localized wear in softer materials which would otherwise occur. Stated otherwise, if the wear segments 14 were axially spaced with lesser resistant material disposed therebetween, this lesser resistant material would wear more quickly and form circumferential grooves or races in the face of the liner assembly. This has a detrimental effect on the comminuting process, since uniformity of movement is lost and the ore fragments tend to congregate in the grooved areas. Of course, in addition to a lesser efficient comminuting process, the liner assembly also wears more quickly since it is the softer material rather than the harder material which is exposed to the wear.

Accordingly, it will be appreciated that a liner assembly comprising a plurality of circumferentially spaced, continuous axial wear surfaces not only comminutes the ore fragments more efficiently, but also has an increased wear life.

What is claimed is:

1. A liner assembly for the shell of an ore grinding machine having a predetermined axis of rotation, the liner assembly comprising:

a plurality of longitudinal holder segments having first and second ends and each defining a mounting surface constructed for mounting engagement with the inner surface of said shell, and a grinding surface;

each holder segment further defining a longitudinal channel extending from one end to the other, said longitudinal channel having a closed bottom and opening at the grinding surface, and being further defined by longitudinal sides that converge at least in part toward the grinding surface;

and a plurality of longitudinal wear inserts for the holder segments, each insert sized for lengthwise insertion into one of said longitudinal channels and being one piece with a cross section that substantially fills the channel, and each insert further comprises longitudinal sides that converge at least in part in conformance with the channel sides so that the insert is retained within the channel;

and means for securing the holder segments to the shell of the ore grinding machine, the holder segments being arranged in the assembly with the longitudinal channels and wear inserts extending axially of the shell.

2. The liner assembly defined by claim 1, wherein the liner segments are mounted to the shell in end-to-end relationship to block movement of the inserts from the channels.

3. The liner assembly defined by claim 2, wherein the shell defines an inner cylindrical surface, and the wear segments are mounted to the inner shell surface in axial rows.

4. The liner assembly defined by claim 3, wherein the wear segments are further mounted to the inner shell surface in circumferential rows.

5. The liner assembly defined by claim 1, wherein a plurality of said wear inserts are provided for each holder segment, the cumulative length of said inserts approximating the length of said channel.

6. The liner assembly defined by claim 5, wherein three of said wear inserts are provided for each holder segment.

7. The liner assembly defined by claim 1, wherein the wear inserts are formed from material which has a greater resistance to abrasion than the material of said holder segments.

8. The liner assembly defined by claim 7, wherein the wear inserts are formed from martensitic white iron.

9. The liner assembly defined by claim 7, wherein the wear inserts are formed from martensitic steel.

10. The liner assembly defined by claim 7, wherein the holder segments are formed from material which has a better resistance to impact than the material of said wear inserts.

11. The liner assembly defined by claim 1, which further comprises means for securing the wear inserts in said longitudinal channels.

12. The liner assembly defined by claim 11, wherein the securing means comprises a locking bolt passing transversely through the holder segment and associated wear insert.

13. The liner assembly defined by claim 11, wherein the fastening means comprises epoxy placed to adhesively bond the wear inserts in said longitudinal channels.

14. The liner assembly defined by claim 1, wherein the wear segments are arranged in the assembly in axial rows.

15. The liner assembly defined by claim 14, wherein the holder segments and wear inserts are configured to define axially extending elevated ridges.

16. The liner assembly defined by claim 14, wherein the wear inserts and each axial row are disposed in end for end relation to define a substantially continuous elevated ridge.

17. The liner assembly defined by claim 1, wherein the longitudinal sides of the channel extend in longitudinal, parallel relation.

18. The liner assembly defined by claim 14, wherein each of the wear segments comprises a solid transverse cross section.

19. An improved structural combination for use in a liner assembly for the shell of an ore grinding machine, comprising:

a longitudinal holder segment having first and second ends and defining a mounting surface constructed for mounting engagement with the inner surface of the shell, and a grinding surface;

the holder segment having a longitudinal channel formed therein that extends from one end to the other, said longitudinal channel having a closed bottom and opening at the grinding surface, and being further defined by longitudinal sides that converge at least in part toward the grinding surface;

and at least one longitudinal wear insert sized for lengthwise insertion into the longitudinal channel and being one piece with a cross section that substantially fills the channel, the insert further comprising longitudinal sides that converge at least in part in conformance with the channel sides so that the insert is retained within the channel;

the wear insert being formed from a material that has a greater resistance to abrasion than the material of the holder segment;

the holder segment and wear insert being configured to together define an elevated, longitudinally extending ridge to assist in grinding the ore.

20. The combination defined by claim 19, wherein the holder segment further comprises first and second upstanding, opposed walls that extend longitudinally over its length, the longitudinal channel being defined between the opposed walls.

21. The combination defined by claim 20, wherein the holder segment further comprises a plurality of integrally formed bridge members that transversely span the longitudinal channel between the opposed walls.

22. The combination defined by claim 19, wherein a plurality of said wear inserts are provided for the holder segment, the cumulative length of said inserts approximating the length of said channel.

23. The combination defined by claim 19, wherein the holder segment is formed from material which has a better resistance to impact than the material of the wear insert.

24. The combination defined by claim 19, which further comprises means for securing the wear insert in the longitudinal channel.

* * * * *